US008747677B2

(12) United States Patent
Vandenbroek et al.

(10) Patent No.: US 8,747,677 B2
(45) Date of Patent: Jun. 10, 2014

(54) MAGNETIC SEPARATION DEVICE

(75) Inventors: Tracy Vandenbroek, Austin, TX (US); Mark Coffey, Austin, TX (US); Jarden Krager, Austin, TX (US)

(73) Assignee: Luminex Corporation, Austin, TX (US)

( * ) Notice: Subject to any disclaimer, the term of this patent is extended or adjusted under 35 U.S.C. 154(b) by 453 days.

(21) Appl. No.: 13/083,089

(22) Filed: Apr. 8, 2011

(65) Prior Publication Data

US 2011/0247984 A1 Oct. 13, 2011

Related U.S. Application Data

(60) Provisional application No. 61/322,729, filed on Apr. 9, 2010.

(51) Int. Cl.
*B03C 1/30* (2006.01)
*B03C 1/28* (2006.01)

(52) U.S. Cl.
CPC ..... *B03C 1/288* (2013.01); *B03C 2201/26* (2013.01); *B03C 2201/28* (2013.01); *B03C 1/30* (2013.01)
USPC ..... 210/695; 210/222; 210/232; 422/400; 422/549; 436/526

(58) Field of Classification Search
USPC ..... 210/222, 232, 695; 436/526; 422/400, 422/549
See application file for complete search history.

(56) References Cited

U.S. PATENT DOCUMENTS

| | | | | |
|---|---|---|---|---|
| 4,126,458 | A | 11/1978 | Creatura et al. | 430/100 |
| 4,230,685 | A | 10/1980 | Senyei et al. | 436/526 |
| 4,267,247 | A | 5/1981 | Ziolo et al. | 430/123.58 |
| 4,339,337 | A | 7/1982 | Tricot et al. | 252/62.54 |
| 4,506,030 | A | 3/1985 | Jones | 502/155 |
| 4,554,088 | A | 11/1985 | Whitehead et al. | 252/62.54 |
| 4,774,265 | A | 9/1988 | Ugelstad et al. | 521/55 |
| 4,988,618 | A * | 1/1991 | Li et al. | 210/222 |
| 5,032,381 | A | 7/1991 | Bronstein et al. | 435/4 |
| 5,091,206 | A | 2/1992 | Wang et al. | 427/2.18 |
| 5,200,270 | A | 4/1993 | Ishida et al. | 428/403 |

(Continued)

FOREIGN PATENT DOCUMENTS

| | | |
|---|---|---|
| EP | 0 463 144 | 1/1992 |
| EP | 0 919 285 | 6/1999 |

(Continued)

OTHER PUBLICATIONS

"Magnetic Separation for Multiplex Assays," Millipore Corporation. 2010.

(Continued)

*Primary Examiner* — David A Reifsnyder
(74) *Attorney, Agent, or Firm* — Parker Highlander PLLC

(57) ABSTRACT

A magnetic separation device comprising a magnetic base and a retention mechanism, as well as a method of evacuating liquid from a well plate containing liquid and magnetic particles, are disclosed. In specific embodiments, the retention mechanism comprises one or more wire clips. In certain embodiments, the magnetic base comprises apertures configured to receive the wire clips. The retention mechanism can be configured to secure a well plate to the magnetic base so that a user may evacuate liquid from a well plate containing liquid and magnetic particles. In certain embodiments, the method comprises inverting the magnetic separation device and well plate. In particular embodiments, the method comprises rapidly and forcefully inverting magnetic separation device and well plate.

11 Claims, 8 Drawing Sheets

(56) References Cited

U.S. PATENT DOCUMENTS

| | | | | |
|---|---|---|---|---|
| 5,283,079 | A | 2/1994 | Wang et al. | 427/2.13 |
| 5,356,713 | A | 10/1994 | Charmot et al. | 428/407 |
| 5,395,688 | A | 3/1995 | Wang et al. | 428/327 |
| 5,648,124 | A | 7/1997 | Sutor et al. | 427/475 |
| 5,736,330 | A | 4/1998 | Fulton | 435/6.12 |
| 5,779,907 | A * | 7/1998 | Yu | 210/222 |
| 5,948,627 | A | 9/1999 | Lee et al. | 435/7.24 |
| 5,981,180 | A | 11/1999 | Chandler et al. | 435/6.12 |
| 6,013,531 | A | 1/2000 | Wang et al. | 436/526 |
| 6,046,807 | A | 4/2000 | Chandler | 356/318 |
| 6,133,047 | A | 10/2000 | Elaissari et al. | 436/526 |
| 6,139,800 | A | 10/2000 | Chandler | 422/82.08 |
| 6,193,892 | B1 | 2/2001 | Krueger et al. | 210/695 |
| 6,266,354 | B1 | 7/2001 | Chino et al. | 372/43.01 |
| 6,268,222 | B1 | 7/2001 | Chandler et al. | 436/523 |
| 6,441,904 | B1 | 8/2002 | Shakespeare | 356/429 |
| 6,449,562 | B1 | 9/2002 | Chandler et al. | 702/19 |
| 6,514,295 | B1 | 2/2003 | Chandler et al. | 8/607 |
| 6,524,793 | B1 | 2/2003 | Chandler et al. | 435/6.12 |
| 6,527,972 | B1 | 3/2003 | Fuchs et al. | 252/62.54 |
| 6,592,822 | B1 | 7/2003 | Chandler | 422/82.05 |
| 6,599,331 | B2 | 7/2003 | Chandler et al. | 8/611 |
| 6,632,526 | B1 | 10/2003 | Chandler et al. | 428/402 |
| 6,645,431 | B2 | 11/2003 | Astle | 422/527 |
| 6,929,859 | B2 | 8/2005 | Chandler et al. | 428/403 |
| 6,939,720 | B2 | 9/2005 | Chandler et al. | 436/518 |
| 7,829,026 | B2 | 11/2010 | Su et al. | 422/527 |
| 2002/0070173 | A1 | 6/2002 | Otto et al. | 210/695 |
| 2003/0186465 | A1 | 10/2003 | Kraus et al. | 436/526 |
| 2003/0205511 | A1 | 11/2003 | Olivier et al. | 210/95 |
| 2006/0134775 | A1 | 6/2006 | Phillips | 435/287.2 |
| 2009/0324451 | A1 | 12/2009 | Yin et al. | 422/400 |

FOREIGN PATENT DOCUMENTS

| | | |
|---|---|---|
| GB | 2017125 | 10/1979 |
| JP | 2004-521316 | 7/2004 |
| WO | WO 91/09141 | 6/1991 |
| WO | WO 96/37313 | 11/1996 |
| WO | WO 97/20214 | 6/1997 |
| WO | WO 01/60519 | 8/2001 |
| WO | WO 03/022440 | 3/2003 |

OTHER PUBLICATIONS

"MagPlex. Manual Washing Procedure for MagPlex Microspheres. Technical Notes." Luminex Corporation. 2010.

Berensmeier, "Magnetic particles for the separation and purification of nucleic acids," *Appl. Microbiol. Biotechnol.*, 73:495-504, 2006.

Office communication issued in Chinese patent application No. 200680002382.5, dated Jul. 4, 2008. (English translation).

Office communication issued in Chinese patent application No. 20068002382.5, dated Dec. 26, 2008. (English translation).

Office communication issued in European patent application No. 06719207.0, dated Aug. 22, 2008.

PCT International Search Report and Written Opinion issued in International application No. PCT/US2011/031755 dated Jan. 19, 2012.

PCT International Search Report issued in International application No. PCT/US2006/002257, mailed Jun. 19, 2006.

Saiyed et al., "Application of magnetic techniques in the field of drug discovery and biomedicine," *Biomagn. Res. Technol.*, 1(1):2, 2003.

U.S. Appl. No. 60/719,010 entitled "Methods and Systems for Image Data Processing," by Wayne D. Roth, filed Sep. 21, 2005.

* cited by examiner

MAGNETIC SEPARATION DEVICE

CROSS-REFERENCE TO RELATED APPLICATION

This application claims priority to U.S. Provisional Patent Application Ser. No. 61/322,729 filed Apr. 9, 2010, which is herein incorporated by reference in its entirety.

BACKGROUND INFORMATION

Magnetic microspheres are used in several methods, including for example, protein purification, protein immunoprecipitation, high throughput DNA isolation, poly (A) mRNA separation, cell separation and cell purification. Magnetic microspheres are also used in biomedical applications such as drug delivery (Saiyed Z, Telang S, Ramchand C. "Application of magnetic techniques in the field of drug discovery and biomedicine". Biomagn Res Technol. 2003 Sep. 18; 1(1):2), incorporated herein by reference. Luminex MagPlex® Microspheres can be used for multiplexed protein and nucleic acid detection using the Luminex® 100/200™ and FLEXMAP 3D® instrument systems.

Magnetic Microspheres are typically composed of superparamagnetic material embedded within a plastic bead of 1-7 μm in diameter and are easily magnetized with an external magnetic field. Once the magnet is removed, the magnetic microspheres are immediately redispersed (Saiyed, et al; 2003). Due to these properties, magnetic microspheres have become a popular alternative to standard separation techniques, such as manual or automated filtration through a membrane. The MagPlex Microspheres are polystyrene beads embedded with superparamagnetic material measuring 6.4 μm in diameter. The functional carboxyl groups on the surface of the MagPlex Microspheres allow for easy coupling to an amine group such as those found in proteins and modified oligonucleotides. MagPlex Microspheres also contain an internal array of up to 3 dyes which color code the beads, thus allowing for up to 80-plex multiplexing using the Luminex 100/200 instrument or up to 500-plex multiplexing using the FLEXMAP 3D instrument.

Washing of well plates containing the magnetic microspheres has traditionally been accomplished using an automated plate washer or a handheld pipettor. In addition, manual evacuation methods can be used to evacuate liquid reagent from a well plate containing magnetic microspheres and effectively remove supernatant and unbound analytes.

Some users find automated plate washers for magnetic bead washing prohibitively expensive. In addition, a handheld pipettor can be prohibitively time-consuming. An effective manual washing procedure for magnetic bead assays using a magnetic separator is therefore desirable.

SUMMARY

Exemplary embodiments of the present disclosure comprise a magnetic separation device comprising a retention mechanism configured to secure a well plate to a magnetic base. The retention mechanism may comprise two wire clips proximal to the ends of the magnetic base. The wire clips can be configured to engage apertures in the magnetic base and to rotate or pivot about an axis extending between the apertures.

Exemplary embodiments also comprise methods of separating non-magnetic material from magnetic particles using a magnetic separation device. In specific embodiments, a well plate may be secured to the magnetic separation device and quickly and forcefully inverted to evacuate the non-magnetic material from the well plate. In certain embodiments, the non-magnetic material may be a liquid.

Certain embodiments comprise a magnetic separation device configured to secure a well plate, where the magnetic separation device may comprise: a magnetic base comprising a first end, a second end, a first side, and a second side; a first retention mechanism coupled to the magnetic base proximal to the first end; and a second retention mechanism coupled to the magnetic base proximal to the second end. In particular embodiments, the first retention mechanism may comprise a first wire clip and the second retention mechanism may comprise a second wire clip. In specific embodiments, the magnetic base may comprise: a first aperture in the first side proximal to the first end; a second aperture in the second side proximal to the first end; a third aperture in the first side proximal to the second end; and a fourth aperture in the second side proximal to the second end.

In certain embodiments, the first wire clip may comprise a first end inserted into the first aperture and may comprise a second end inserted into the second aperture. In particular embodiments, the second wire clip may comprise a first end inserted into the third aperture and may comprise a second end inserted into the fourth aperture. In specific embodiments, the first wire clip may be configured to rotate about an axis extending between the first aperture and the second aperture, and the second wire clip may be configured to rotate about an axis extending between the third aperture and the fourth aperture. In certain embodiments, the first wire clip may comprise a first offset portion proximal to the first end of the first wire clip and may comprise a second offset portion proximal to the second end of the first wire clip. In particular embodiments, the second wire clip may comprise a first offset portion proximal to the first end of the second wire clip and may comprise a second offset portion proximal to the second end of the second wire clip.

In specific embodiments, the first and second offset portions of the first wire clip may extend away from the first end of the magnetic base, and the first and second offset portions of the second wire clip may extend away from the second end of the magnetic base. In certain embodiments, the first wire clip may comprise a first extension configured to allow a user to grip the first extension and pivot the first wire clip around the first end of the magnetic base. In particular embodiments, the second wire clip may comprise a second extension configured to allow a user to grip the second extension and pivot the second wire clip around the second end of the magnetic base.

In certain embodiments, the first retention mechanism may comprise a first tab and the second retention mechanism may comprise a second tab. In specific embodiments, the first retention mechanism may comprise a first pin and the second retention mechanism may comprise a second pin. In particular embodiments, the first retention mechanism may comprise a first hook and the second retention mechanism may comprise a second hook.

Certain embodiments comprise a method of separating magnetic particles from non-magnetic material in a well plate, where the method may comprise: placing the well plate on a magnetic base; securing the well plate to the magnetic base with a first retention mechanism; and inverting the well plate and the magnetic base so that the non-magnetic material is evacuated from the well plate and the magnetic particles are retained in the well plate.

In particular embodiments, the first retention mechanism comprises a first tab. In certain embodiments, the first retention mechanism comprises a first pin. In specific embodiments, the first retention mechanism comprises a first hook.

In certain embodiments, the non-magnetic material may be liquid. In particular embodiments, the non-magnetic material may comprise a supernatant analyte. In specific embodiments, the magnetic particles may comprise magnetic microspheres.

In certain embodiments, the method may comprise securing the well plate to the magnetic base with a second retention mechanism, where the first retention mechanism secures the well plate proximal to a first end of the magnetic base and wherein the second retention mechanism secures the well plate proximal to a second end of the magnetic base.

In particular embodiments, the first retention mechanism may comprise a first wire clip inserted into a first pair of apertures proximal to the first end, and the second retention mechanism may comprise a second wire clip inserted into a second pair of apertures proximal to the second end. In certain embodiments, securing the well plate to the magnetic base with a first retention mechanism may comprise rotating the first wire clip so that it engages the well plate and exerts a force on the well plate in the direction of the magnetic base. In specific embodiments, securing the well plate to the magnetic base with a second retention mechanism may comprise rotating second the wire clip so that it engages the well plate and exerts a force on the well plate in the direction of the magnetic base. In certain embodiments, inverting the well plate and the magnetic base may comprise rapidly and forcefully inverting the well plate and magnetic base.

Other objects, features and advantages of the present invention will become apparent from the following detailed description. It should be understood, however, that the detailed description and the specific examples, while indicating specific embodiments of the invention, are given by way of illustration only, since various changes and modifications within the spirit and scope of the invention will be apparent to those skilled in the art from this detailed description.

DETAILED DESCRIPTION OF EXEMPLARY EMBODIMENTS

Description of Exemplary Device

Figure 1:
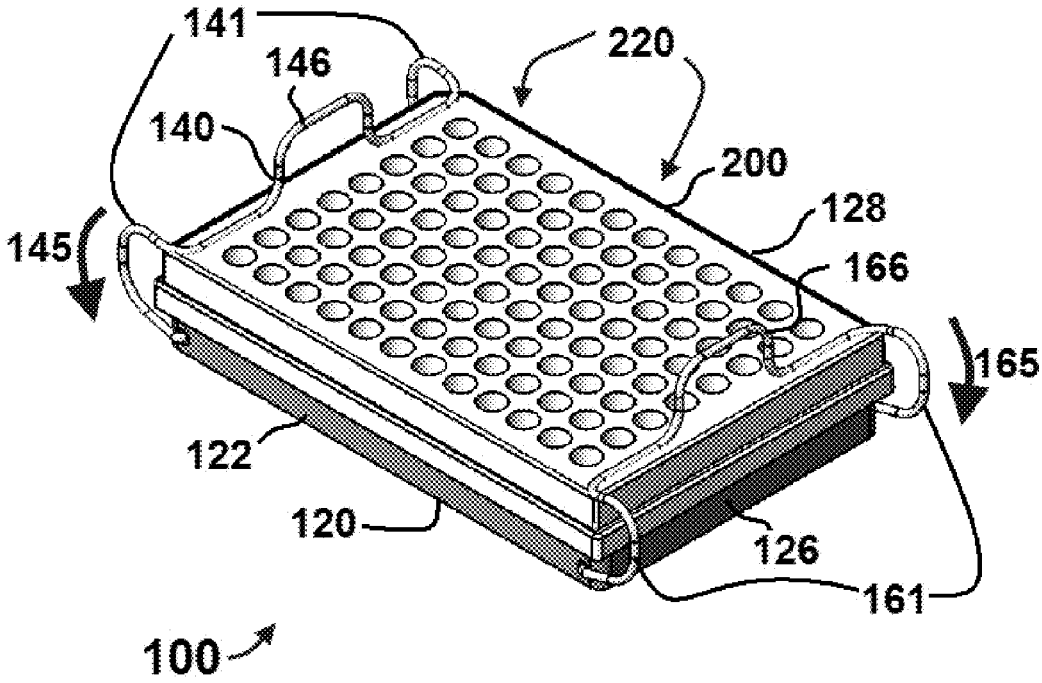
FIG. 1 is a perspective view of a one embodiment of a magnetic separation device coupled to a well plate.
Figure 2:
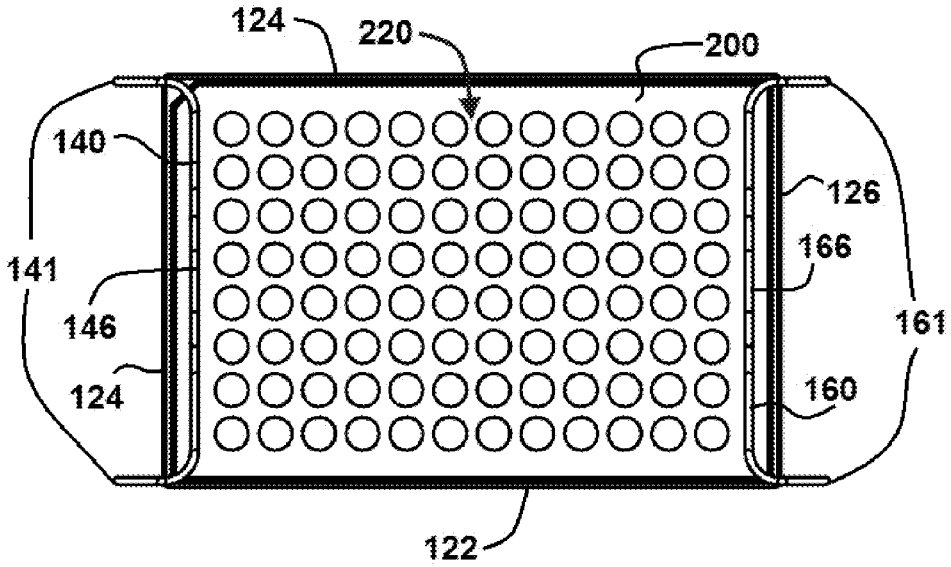
FIG. 2 is top view of the well plate coupled to the embodiment of FIG. 1.
Figure 3:
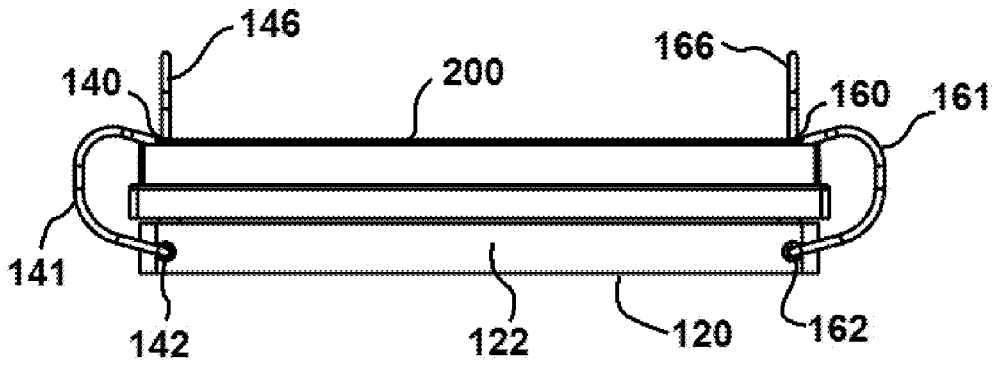
FIG. 3 is a side view of the well plate coupled to the embodiment of FIG. 1.

Referring now to FIGS. 1-3, a first embodiment of a magnetic separation device 100 is shown coupled to a well plate 200. In specific embodiments, well plate 200 is a 96-well plate. In this embodiment, magnetic separation device 100 comprises a magnetic base 120, a first retaining mechanism 140 and a second retaining mechanism 160. In the embodiment shown, first and second retaining mechanisms 140 and 160 are each configured as spring wire clips. In other embodiments, first and second retaining mechanisms 140 and 160 may be configured as hooks, tabs, pins, etc. As shown, well plate 200 comprises a plurality of wells 220.

In the illustrated embodiment, magnetic base 120 comprises a first end 124 and a second end 126, a first side 122, and a second side 128. In this embodiment, first retaining mechanism 140 is coupled to magnetic base 120 proximal to first end 124, and second retaining mechanism 160 is coupled to magnetic base 120 proximal to first end 124. In this particular embodiment, each end of first retaining mechanism 140 is configured to insert into one of a pair of apertures 142 (only one of which is visible in the figures) proximal to first end 124. Similarly, each end of second retaining mechanism 160 is configured to insert into one of a pair of apertures 162 (only one of which is visible in the figures) proximal to first end 126.

As shown in FIGS. 1-3, retaining mechanisms 140 and 160 are in the upright or assembled position. In this position, retaining mechanisms 140 and 160 engage well plate 200 and exert forces on well plate 200 toward magnetic base 120, securely coupling well plate 200 to magnetic base 120. First and second retaining mechanisms 140 and 160 may be pivoted or rotated in the directions of arrows 145 and 165 to move retaining mechanisms 140, 160 to the down position.

Figure 4:
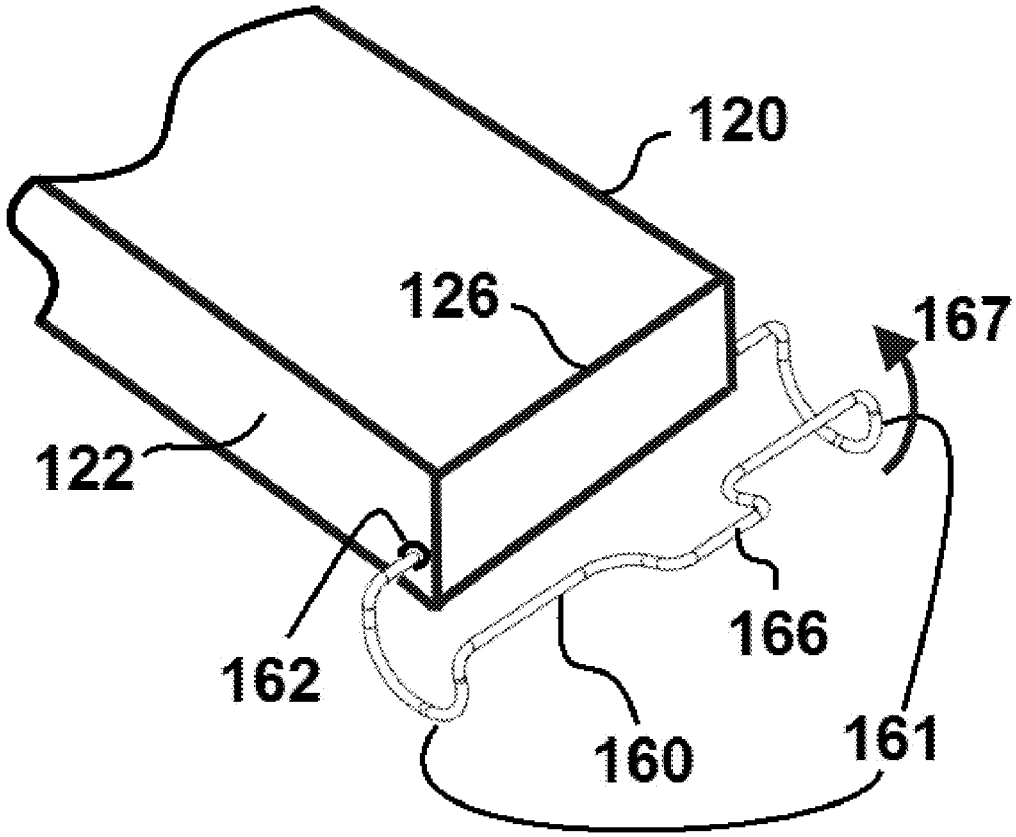
FIG. 4 is a perspective view of the well plate coupled to the embodiment of FIG. 1.
Figure 5:
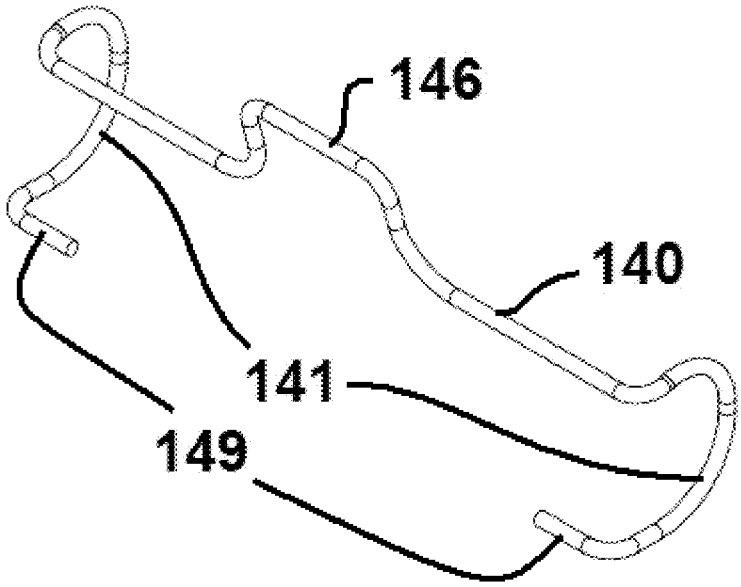
FIG. 5 is a perspective view of an exemplary embodiment of a retention mechanism of FIG. 1.
Figure 6:
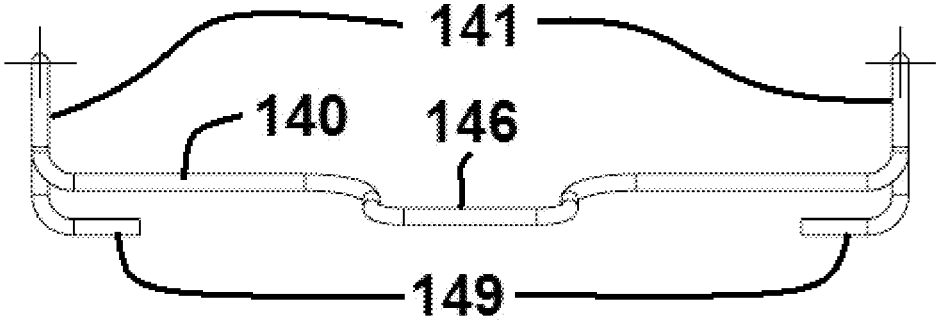
FIG. 6 is a top view of the embodiment of FIG. 5.
Figure 7:
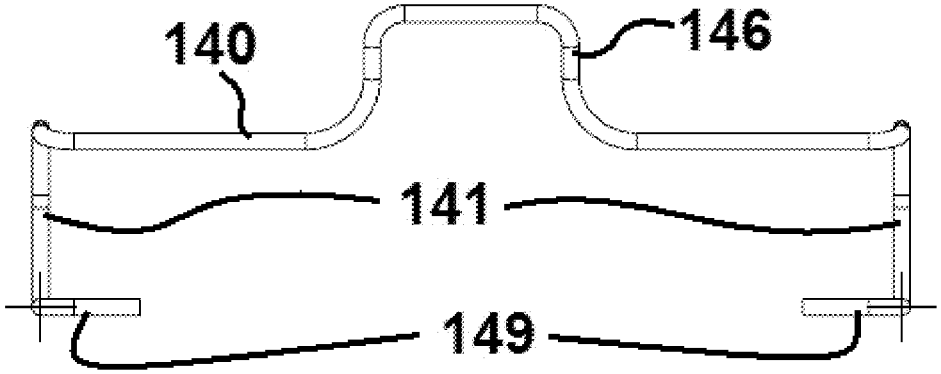
FIG. 7 is a front view of the embodiment of FIG. 5.
Figure 8:
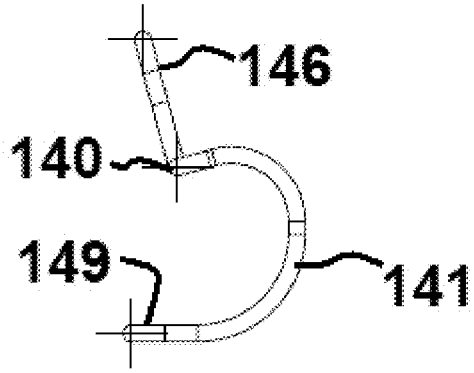
FIG. 8 is an end view of the embodiment of FIG. 5.
Figure 9:
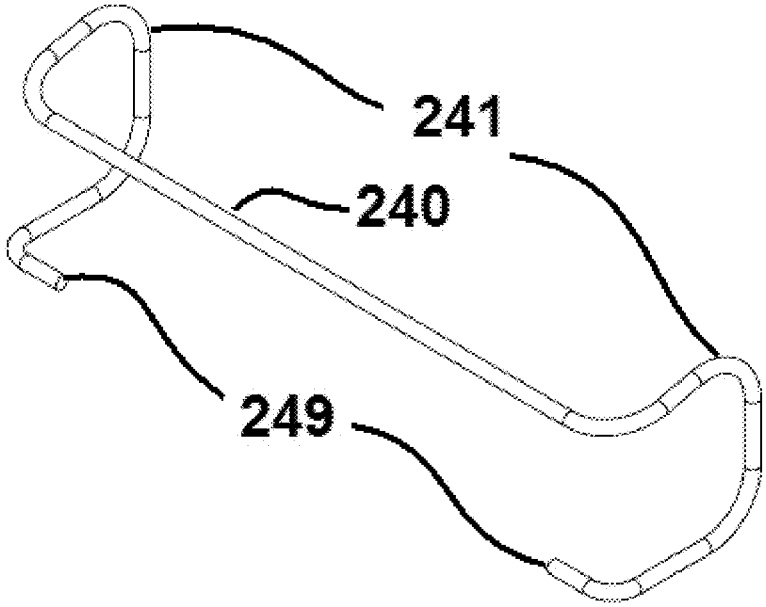
FIG. 9 is a perspective view of an exemplary embodiment of a retention mechanism.
Figure 10:
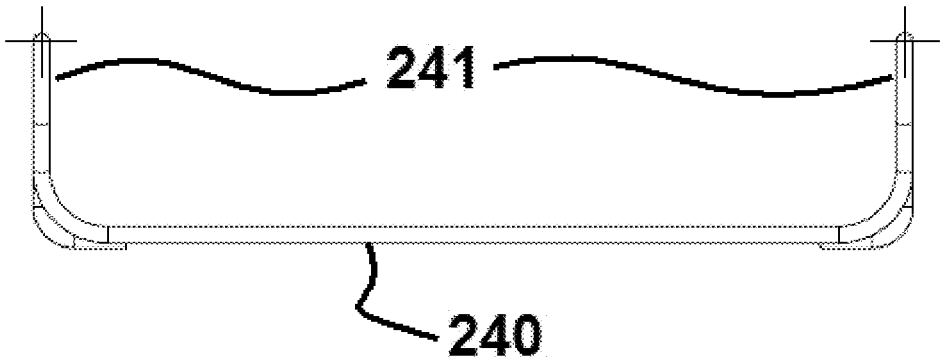
FIG. 10 is a top view of the embodiment of FIG. 9.
Figure 11:
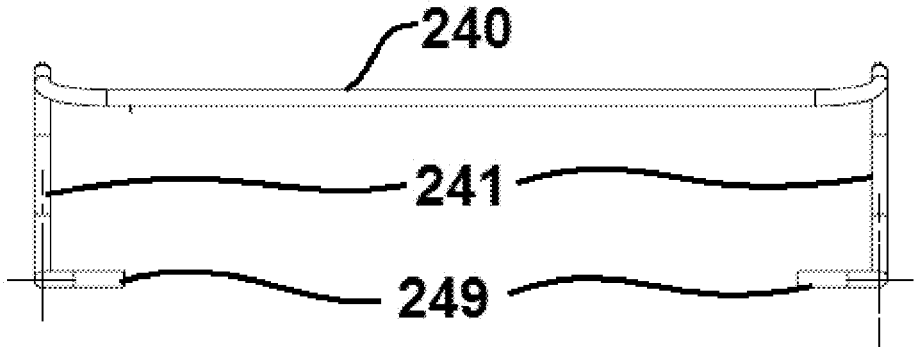
FIG. 11 is a front view of the embodiment of FIG. 9.
Figure 12:
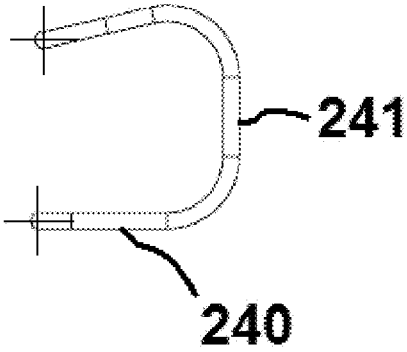
FIG. 12 is an end view of the embodiment of FIG. 9.
Figure 13:
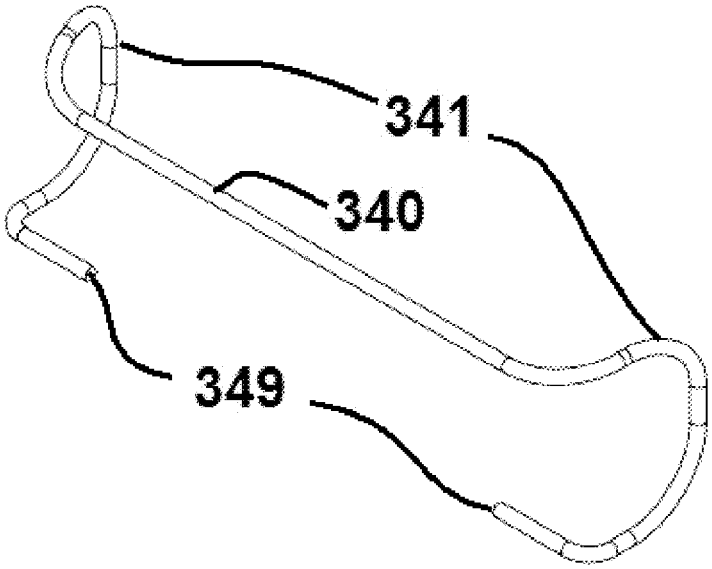
FIG. 13 is a perspective view of an exemplary embodiment of a retention mechanism.
Figure 14:
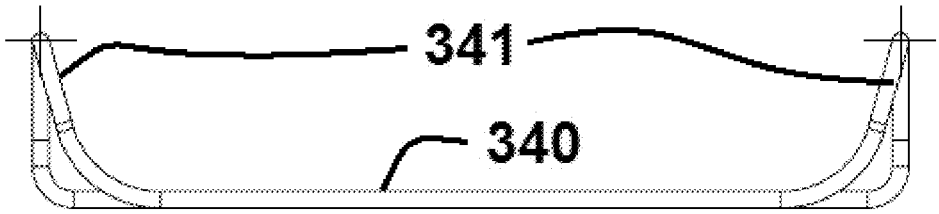
FIG. 14 is a top view of the embodiment of FIG. 13.
Figure 15:
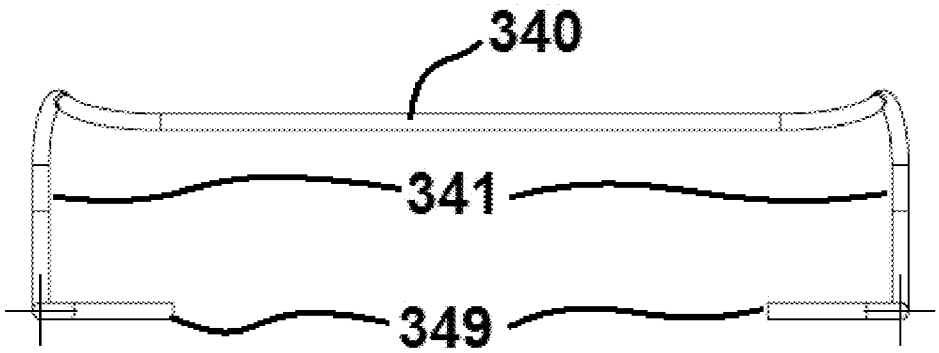
FIG. 15 is a front view of the embodiment of FIG. 13.
Figure 16:
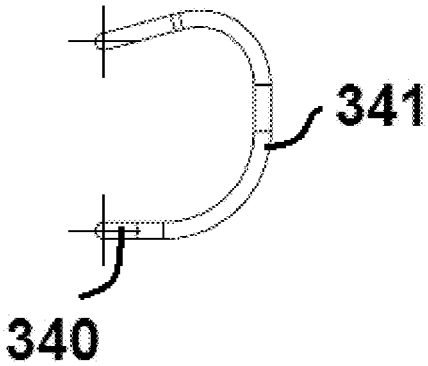
FIG. 16 is an end view of the embodiment of FIG. 13.

FIG. 4 provides a view of first end 126 of magnetic base 200 with second retaining mechanism 160 in the down position (before well plate 200 has been coupled to magnetic base 120). From the position shown in FIG. 4, a user may place well plate 200 onto magnetic base 120 and then rotate second retaining mechanism 160 in the direction of arrow 167. It is understood that first retaining mechanism 140 (not shown in FIG. 4) may be manipulated similarly in order to secure well plate 200 to magnetic base 120.

When retaining mechanisms 140, 160 are in the upright or assembled position, they securely couple well plate 200 to magnetic base 120. As explained in more detail below, this can allow a user to quickly and forcefully invert magnetic separation device 100 and well plate 200 and extract non-magnetic material (e.g., a liquid reagent) from well plate 200. Retaining mechanisms 140, 160 allow a user to exert this force to invert the assembly without having to concentrate on maintaining the coupling between well plate 200 and magnetic base 120.

As shown in FIG. 1, retaining mechanisms 140 and 160 comprise offset portions 141 and 161 which extend from apertures 142 and 162 and away from ends 124 and 126. This configuration allows retaining mechanisms 140 and 160 to pivot about the axes between apertures 142 and 162 and clear ends 124 and 126 when moving between the down and up positions. Retaining mechanisms 140 and 160 further each comprise an extension 146 and 166 that allow a user to easily grip retaining mechanisms 140 and 160 and rotate them between the up and down positions. This permits easier coupling and removal of well plate 200 from magnetic base 120.

FIGS. 5-8 illustrate a perspective and orthographic views of retention mechanism 140 (which is configured equivalent to retention mechanism 160) separated from magnetic base 120. As shown in the figures, retention mechanism 140 comprise end portions 149 which are configured to be inserted into apertures 142. FIGS. 5-8 also provide more detailed views of offset portions 141 and extension 146.

Other embodiments may comprise retaining mechanisms with configurations different than that shown in FIGS. 5-8.

For example, FIGS. 9-12 illustrate a perspective and orthographic views of one embodiment of a retention mechanism 240. This version is similar to the retention mechanism shown in FIGS. 1-4, but does not comprise an extension portion. Retention mechanism 240 does comprise a pair of offset portions 241 and end portions 249, however.

Referring now to FIGS. 13-16, another embodiment of a retention mechanism 340 is similar to that shown in FIGS. 9-12. This embodiment comprises end portions 349 and a different configuration of offset portions 341, as visible in the end view of FIG. 16.

Exemplary Method of Operation

With well plate 200 secured to magnetic separation device 100 as shown in FIG. 1, a user can manually evacuate liquid reagent (or other non-magnetic material) from wells 220. In one exemplary method, a user can allow well plate 200 and magnetic separation device 100 to remain in the upright position for approximately one minute to allow the magnetic spheres to reach the bottom of each well 220. After a sufficient time has elapsed for the magnetic spheres to reach the bottom of each well 220, the user can then place well plate 200 and magnetic separation device 100 over a sink or biohazard receptacle. The user may then rapidly and forcefully invert well plate 200 and magnetic separation device 100 in order to evacuate the liquid reagent from the wells 220 of well plate 200 while retaining the magnetic particles in the wells 220, as well as any reagent, analyte, etc., bound to the magnetic particles.

The method for evacuating liquid from a well plate described above provides several benefits to the user. For example, this method requires significantly less time to evacuate each of the wells than the use of a handheld pipettor. In addition, magnetic separation device 100 is less expensive than an automated plate washer.

The invention claimed is:

1. A magnetic separation device configured to secure a well plate, the magnetic separation device comprising:
- a magnetic base comprising a first end, a second end, a first side, and a second side;
- a first retention mechanism coupled to the magnetic base proximal to the first end; and
- a second retention mechanism coupled to the magnetic base proximal to the second end, wherein:
  - the first retention mechanism is a first wire clip and the second retention mechanism is a second wire clip;
  - the magnetic base comprises:
    - a first aperture in the first side proximal to the first end;
    - a second aperture in the second side proximal to the first end;
    - a third aperture in the first side proximal to the second end; and
    - a fourth aperture in the second side proximal to the second end; and
  - the first wire clip comprises a first end inserted into the first aperture and comprises a second end inserted into the second aperture; and
  - the second wire clip comprises a first end inserted into the third aperture and comprises a second end inserted into the fourth aperture.

2. The magnetic separation device of claim 1 wherein:
- the first wire clip is configured to rotate about an axis extending between the first aperture and the second aperture; and
- the second wire clip is configured to rotate about an axis extending between the third aperture and the fourth aperture.

3. The magnetic separation device of claim 2 wherein:
- the first wire clip comprises a first offset portion proximal to the first end of the first wire clip and comprises a second offset portion proximal to the second end of the first wire clip;
- the second wire clip comprises a first offset portion proximal to the first end of the second wire clip and comprises a second offset portion proximal to the second end of the second wire clip.

4. The magnetic separation device of claim 3 wherein the first and second offset portions of the first wire clip extend away from the first end of the magnetic base and wherein the first and second offset portions of the second wire clip extend away from the second end of the magnetic base.

5. The magnetic separation device of claim 3 wherein:
- the first wire clip comprises a first extension configured to allow a user to grip the first extension and pivot the first wire clip around the first end of the magnetic base; and
- the second wire clip comprises a second extension configured to allow a user to grip the second extension and pivot the second wire clip around the second end of the magnetic base.

6. A method of separating magnetic particles from non-magnetic material in a well plate, the method comprising:
- placing the well plate on a magnetic base, wherein the magnetic base comprises a first end, a second end, a first side, and a second side;
- securing the well plate to the magnetic base with a first retention mechanism coupled to the magnetic base proximal to the first end and a second retention mechanism coupled to the magnetic base proximal to the second end;
- wherein:
  - the first retention mechanism is a first wire clip and the second retention mechanism is a second wire clip;
  - the magnetic base comprises:
    - a first aperture in the first side proximal to the first end;
    - a second aperture in the second side proximal to the first end;
    - a third aperture in the first side proximal to the second end; and
    - a fourth aperture in the second side proximal to the second end; and
  - the first wire clip comprises a first end inserted into the first aperture and comprises a second end inserted into the second aperture; and
  - the second wire clip comprises a first end inserted into the third aperture and comprises a second end inserted into the fourth aperture; and
- inverting the well plate and the magnetic base so that the non-magnetic material is evacuated from the well plate and the magnetic particles are retained in the well plate.

7. The method of claim 6 wherein the non-magnetic material is liquid.

8. The method of claim 6 wherein the non-magnetic material comprises a supernatant analyte.

9. The method of claim 6 wherein the magnetic particles comprise magnetic microspheres.

10. The method of claim 6 wherein:
- securing the well plate to the magnetic base with the first retention mechanism comprises rotating the first wire clip so that it engages the well plate and exerts a force on the well plate in the direction of the magnetic base; and
- securing the well plate to the magnetic base with the second retention mechanism comprises rotating the second wire clip so that it engages the well plate and exerts a force on the well plate in the direction of the magnetic base.

11. The method of claim 6 wherein inverting the well plate and the magnetic base comprises rapidly and forcefully inverting the well plate and magnetic base.

* * * * *

UNITED STATES PATENT AND TRADEMARK OFFICE

CERTIFICATE OF CORRECTION

PATENT NO. : 8,747,677 B2
APPLICATION NO. : 13/083089
DATED : June 10, 2014
INVENTOR(S) : Vandenbroek et al.

It is certified that error appears in the above-identified patent and that said Letters Patent is hereby corrected as shown below:

On the Title Page

Item (56) References Cited - Other Publications, delete the 4th reference on page 2, Column 2, line 7, "Office communication issued in Chinese patent application No. 20068002382.5, dated Dec. 26, 2008. (English translation)." and replace with --Office communication issued in Chinese patent application No. 200680002382.5, dated Dec. 26, 2008. (English translation).-- therefor.

Signed and Sealed this
Nineteenth Day of August, 2014

Michelle K. Lee

Michelle K. Lee
*Deputy Director of the United States Patent and Trademark Office*